US010213813B2

(12) United States Patent
Bürgin et al.

(10) Patent No.: US 10,213,813 B2
(45) Date of Patent: Feb. 26, 2019

(54) METHOD AND DEVICE FOR CLEANING INTERIORS OF CONTAINERS AND SYSTEMS

(71) Applicant: BANG & CLEAN GMBH, Othmarsingen (CH)

(72) Inventors: Markus Bürgin, Remetschwill (CH); Rainer Flury, Schliern bei Köniz (CH)

(73) Assignee: BANG & CLEAN GMBH, Othmarsingen (CH)

( * ) Notice: Subject to any disclaimer, the term of this patent is extended or adjusted under 35 U.S.C. 154(b) by 64 days.

(21) Appl. No.: 15/116,565

(22) PCT Filed: Feb. 4, 2015

(86) PCT No.: PCT/CH2015/000011
§ 371 (c)(1),
(2) Date: Aug. 4, 2016

(87) PCT Pub. No.: WO2015/120563
PCT Pub. Date: Aug. 20, 2015

(65) Prior Publication Data

US 2016/0346813 A1 Dec. 1, 2016

(30) Foreign Application Priority Data

Feb. 11, 2014 (CH) ..... 177/14

(51) Int. Cl.
*B08B 7/00* (2006.01)
*F23J 3/02* (2006.01)
(Continued)

(52) U.S. Cl.
CPC ..... *B08B 7/0007* (2013.01); *F23J 3/02* (2013.01); *F27D 25/006* (2013.01); *F28G 1/16* (2013.01); *F28G 7/005* (2013.01)

(58) Field of Classification Search
CPC ..... B08B 7/0007; F27D 25/006; F23D 2206/0021; F23D 2208/10; F28G 7/005
(Continued)

(56) References Cited

U.S. PATENT DOCUMENTS 4,089,702 A * 5/1978 Enoksson ..... B08B 7/0007 102/302
5,082,502 A * 1/1992 Lee ..... B08B 7/0007 134/1
(Continued)

FOREIGN PATENT DOCUMENTS

CH 705844 A2 * 6/2013 ..... B08B 7/0007
EP 1 362 213 12/2004
(Continued)

*Primary Examiner* — Tho V Duong
(74) *Attorney, Agent, or Firm* — Rankin, Hill & Clark LLP

(57) ABSTRACT

A method and cleaning device for removing deposits from interiors of receptacles and installations by way of explosion technology. The cleaning device includes a cleaning apparatus with a receiving space, and at least one pressure container that is connected via at least one metering fitting to the cleaning apparatus. The controlled introduction of the at least one gaseous component into the cleaning apparatus is effected according to the principle of the differential pressure between a maximal pressure at the beginning of the introduction and a nominal residual pressure after completion of the introduction. For this, based on a maximal pressure, the nominal residual pressure in the pressure container is ascertained on the basis of the quantity of gaseous component to be introduced, and the introduction of the at least one gaseous component is stopped on reaching the nominal residual pressure, which thereby lies in the overpressure range.

20 Claims, 2 Drawing Sheets

(51) Int. Cl.
*F27D 25/00* (2010.01)
*F28G 7/00* (2006.01)
*F28G 1/16* (2006.01)

(58) Field of Classification Search
USPC ..... 165/303
See application file for complete search history.

(56) References Cited

U.S. PATENT DOCUMENTS

| | | | | |
|---|---|---|---|---|
| 6,935,281 | B2 * | 8/2005 | Ruegg | B08B 7/0007 122/379 |
| 2005/0039775 | A1 | 2/2005 | Whitlock | |
| 2011/0226284 | A1 | 9/2011 | Taylor et al. | |
| 2014/0209179 | A1 * | 7/2014 | Maier | G01F 1/363 137/12 |

FOREIGN PATENT DOCUMENTS

| | | | | | |
|---|---|---|---|---|---|
| GB | 538484 | A | * | 8/1941 | B60K 15/03006 |
| GB | 2470725 | B | * | 9/2013 | F02D 19/0631 |
| JP | 2003-148688 | | | 5/2003 | |
| JP | 2003-327976 | | | 11/2003 | |
| JP | 2005-306212 | | | 11/2005 | |
| JP | 2006077638 | A | * | 3/2006 | |
| JP | 2007-503114 | | | 2/2007 | |

* cited by examiner

METHOD AND DEVICE FOR CLEANING INTERIORS OF CONTAINERS AND SYSTEMS

BACKGROUND OF THE INVENTION

Field of the Invention

The invention generally relates to the field of cleaning interiors of receptacles and installations and, more particularly, toward a method and a device for removing deposits in the interiors of receptacles and installations, by way of explosion technology.

Description of Related Art

The device and method serve for cleaning dirty and slagged receptacles and installations with caking on their inner walls, particularly incineration installations.

Heating surfaces, e.g. of waste incineration plants or generally incineration boilers are generally exposed to large contamination or fouling. This fouling has inorganic compositions and typically arises due to deposits of ash particles on the wall. Coatings in the region of high flue gas temperatures are mostly very hard, since they remain stuck to the wall in either molten form or are melted on the wall or are stuck together by way of substances melting or condensing at a lower temperature, when solidifying on the colder boiler wall. Such coatings are very difficult to remove and are inadequately removed by way of known cleaning methods. This leads to the boiler having to be being periodically taken out of service and cooled for the purpose of cleaning. For this, the construction of a scaffold in the furnace or kiln is often necessary, since such boilers usually have extremely large dimensions. This moreover requires an operational interruption of several days or weeks and is extremely unpleasant and unhealthy for the cleaning personnel due to the large occurrence of dust and dirt. One consequence, which mostly inherently occurs with an operational interruption of an installation, is damage to the container materials themselves as a result of the large temperature changes. The installation standstill costs due to the production or income losses are an important cost factor, additionally to the cleaning and repair costs.

Conventional cleaning methods, which are used when the installations are shut down, are, for example boiler beating, as well as the use of steam jet blasters, water jet blasters/soot blasters or shot-cleaning as well as sand blasting.

Moreover, a cleaning method is known, with which the cooled-down or the hot boiler, which is in operation, is cleaned by way of introducing and igniting explosive bodies. The heat surface caking is blown away due to the impact of the detonation, as well as due to the wall oscillations produced by the shock waves. The cleaning time can be significantly shortened with this method, in comparison to the convention cleaning methods.

The disadvantage with this method is the necessity for explosives. Apart from the high costs for the explosive material, a huge expense with regard to safety must be met, for example with the storage of the explosive, in order to avoid accidents or theft.

A further cleaning method is known from EP 1 362 213 B1, which likewise makes use of means for the production of an explosion. Instead of explosive, according to this method however, a container envelope, which is inflatable with an explosive, gaseous mixture, is attached onto the end of a cleaning lance. The explosive, gaseous mixture is produced from at least two gaseous components.

The cleaning lance together with the empty container envelope is introduced into the boiler space and is positioned in the proximity of the location to be cleaned. Subsequently, the container envelope is inflated with an explosive gas mixture. An explosion is produced by way of igniting the gas mixture in the container envelope, and the shock waves of this explosion lead to the detachment of fouling on the boiler walls. The container envelope is shredded and combusted by way of the explosion. It therefore represents a consumable material.

This method and the associated device compared to the explosive technology with explosive and which is mentioned above, has the advantage that the method is favourable with regard to operation. Thus, e.g., the starting components of a gas mixture, which comprises oxygen and a combustible gas, is inexpensive in procurement in comparison to explosives. Moreover, the procurement and handling of the mentioned gases, in contrast to explosives requires no special permits or qualification, so that anyone with a suitable training can carry out the method.

Moreover, it is also advantageous that the starting components are fed to the cleaning lance via separate feed conduits, and the dangerous explosive gas mixture is therefore not created in the cleaning lance until shortly before triggering the explosion. In comparison to explosives, the handling of the individual components of the gas mixture is indeed far less dangerous, since these individually at the most are combustible, but not explosive.

The associated method has the disadvantage that the filling procedure is comparatively slow. This is due to the fact that the gaseous components are introduced out of pressure containers via metering fittings. The gaseous components are hereby made available in the pressure containers in quantities according to the stoichiometric ratio. The emptying of the pressure containers however requires comparatively much time. Thus the exit speed of the gaseous components from the pressure containers or tanks approaches zero in an asymptotic course with an increasing emptying of the pressure containers. This means that the introduction of the gaseous components into the container envelope takes a comparatively disproportionate amount of time, in particular towards the end of the filling procedure.

SUMMARY OF THE INVENTION

It is therefore the object of the present invention, to suggest a cleaning method and an associated cleaning device of the type described above, which permits a more rapid introduction of a defined quantity of gaseous starting components. In particular, the filling of a container envelope should be quicker due to this.

According to a further object, the cleaning method and the associated cleaning device should permit the gaseous components to be introduced in a stoichiometric quantity ratio with comparatively little effort with regard to control technology. Stoichiometric quantity ratio means that the reactants are fed in quantity ratios of a reaction, such that none of the reactants is present is excess. Accordingly, the computation of the stoichiometric quantity ratio is effected on the basis of the associated reaction equation.

The cleaning device according to the invention in particular includes:

a cleaning apparatus with a receiving space for providing an explosive, gaseous mixture from one or with at least one gaseous component;

at least one pressure container that is connected to the cleaning apparatus and is for providing and introducing the at least one gaseous component into the cleaning apparatus;

at least one metering fitting for the metered introduction of the at least one gaseous component out of the at least one pressure container, into the cleaning apparatus;

an ignition device for igniting the explosive, gaseous mixture as well as a control device for the control of the at least one metering fitting and the ignition of the explosive mixture.

The pressure container in particular is connected to the cleaning apparatus via a feed conduit.

The pressure container or containers in particular is/are metering containers for metering the quantity of gaseous component, which is to be introduced into the cleaning apparatus.

The cleaning device in particular also includes at least one pressure sensor for measuring the pressure in the at least one pressure container.

The cleaning device includes means for optimising the introduction of the at least one gaseous component out of the pressure container into the cleaning apparatus, wherein the means includes:

the control device, which is designed for the control of the at least one metering fitting, in dependence on pressure measurement values in the pressure container, which are detected by way of at least one pressure sensor, such that the control device is in the position of ending the introduction of the at least one gaseous component out of the at least one pressure container into the cleaning apparatus, as soon as the measured pressure in the pressure container corresponds to a nominal residual pressure which lies in an overpressure region, or a mechanical device for size reduction of the storage space in the pressure container during the introduction of the at least one gaseous component into the cleaning apparatus.

The optimisation of the introduction includes the increase of the average introduction speed of the at least one gaseous components out of the pressure container into the cleaning apparatus.

The storage space corresponds to that space in the pressure container, which receives the gaseous component subjected to pressure and to be introduced into the cleaning apparatus.

The at least one metering fitting in particular is connected to the control device via a control lead. The at least one pressure sensor in particular is connected to the control device via a data lead.

The method according to the invention in particular has the following method steps:

providing at least one gaseous component in the pressure container at overpressure;

introducing the at least one gaseous component from the pressure container into the cleaning apparatus via the metering fitting;

providing an explosive, gaseous mixture in the receiving space, comprising or consisting of the at least one introduced gaseous component; as well as igniting the explosive, gaseous mixture.

The introduction of the at least one gaseous component from the pressure container into the cleaning apparatus in particular is effected via a feed conduit.

In accordance with the method, the introduction of the at least one gaseous component out of the pressure container into the cleaning apparatus is optimised by way of:

the control of the introduction of the at least one gaseous component into the cleaning apparatus being effected according to the principle of the differential pressure between a maximal pressure at the beginning of the introduction and a nominal residual pressure after the completion of the introduction, wherein the nominal residual pressure lies in the overpressure region, or the storage space in the at least one pressure container is reduced in size during the introduction of the at least one gaseous component into the cleaning apparatus.

According to the differential pressure method, the nominal residual pressure is ascertained, based on the known maximum pressure, in particular on the basis of the quantity of gaseous component which is to be introduced. The introduction of the at least one gaseous component is stopped on reaching the nominal residual pressure. In this manner, the average introduction speed is increased compared to conventional methods, since the introduction speed on reaching a nominal residual pressure is greater than at the end of the emptying of the pressure container.

With regard to the overpressure, it is the case of that pressure value, which results from the difference between the pressure prevailing in the pressure container and the prevailing ambient pressure. The ambient pressure in particular is the pressure prevailing outside the pressure container. The ambient pressure for example is the atmospheric pressure. This means that the pressure container or containers are not emptied to the ambient pressure.

The maximal pressure corresponds to the pressure in the pressure container at the beginning of the introduction. The maximal pressure in particular is defined likewise. The pressure containers are thus likewise filled beforehand with the gaseous starting component until reaching the predefined maximal pressure, by way of the control device.

According to a particular embodiment variant of the invention, the cleaning apparatus is designed for attaching a container envelope, which can be filled with an explosive, gaseous mixture.

The method belonging to this embodiment variant has the following method steps:

attaching a container envelope on the cleaning apparatus;

providing the at least one gaseous component in the pressure container at overpressure;

introducing the at least one gaseous component from the pressure container into the cleaning apparatus via the metering fitting;

providing an explosive gaseous mixture in the receiving space, having or consisting of the at least one introduced, gaseous component and filling the container envelope attached on the cleaning apparatus with an explosive, gaseous mixture;

igniting the explosive, gaseous mixture, wherein the explosive, gaseous mixture in the container envelope is caused to explode.

The introduction of the at least one gaseous component from the pressure container into the cleaning apparatus in particular is effected via a feed conduit.

The associated metering fitting is opened via the control device, for introducing the at least one gaseous component into the cleaning apparatus. The metering fitting concerned is closed again via the control device according to the differential pressure method, as soon as the nominal residual pressure is reached, i.e. as soon as the nominal or desired quantity of gaseous component to be introduced has been introduced.

The at least one metering fitting in particular comprises a valve, such as a magnet valve.

The at least one metering fitting can be attached on the cleaning apparatus, wherein the associated feed conduit is led from the pressure container to the metering fitting.

The at least one metering fitting can be attached at the outlet of the pressure container, wherein the associated feed conduit is led from the metering fitting to the cleaning apparatus.

The feed conduit can be a flexible tubing or a rigid conduit. The feed conduit according to a further development of the invention can be part of the pressure container or even form this. This means that the feed conduit forms the pressure container or is a part thereof. Accordingly, the maximal pressure is (also) built up in the feed conduit.

A check element, such as a check valve, can be arranged downstream of the at least one metering fitting in the flow direction. This protects the metering fitting from a blowback such as can occur, for example, with the ignition of the explosive mixture. The check element moreover also prevents the exchange of components of the explosive mixture between several pressure containers. The check element in particular is arranged upstream of the feed pressure conduit in the flow direction.

A device for feeding an inert gas, such as nitrogen can be arranged at the same location instead of the check element. The introduced inert gas forms a type of buffer and prevents the heating of the metering fitting due to hot explosion gases. On the other hand, the introduced inert gas forms a gas barrier and prevents the exchange of components of the explosive mixture between several metering fittings.

The metering fitting(s) is or are closed after the introduction of the envisaged total volume of explosive mixture. The ignition is activated via the control device simultaneously to the closure of the metering fitting(s) or subsequently to this, and the explosive, gaseous mixture is brought to explosion, which is to say made to explode. The controls of the metering fittings as well as of the ignition device in particular are matched to one another with regard to control technology. The delay between the closure of the metering fitting(s) and the ignition of the explosive, gaseous mixture is a fraction of a second, for example. This delay can be set beforehand.

Accordingly, the introduction and ignition in particular take their course in a fully automatic manner. I.e., in particular no further manual intervention is necessary up to and on explosion, after initiating the introduction.

The control device can comprise an operating unit, via which the operation of the control device is effected. Thus the introduction procedure can be initiated and, as the case may be, settings carried out, via the operating unit. The operating unit can include a touch-screen for operation. The operating unit can be desired in a wireless manner.

The impact of the explosion and the surface that is brought into oscillation due to the shock waves, e.g. a container wall or pipe wall, effect the blasting-away of the wall caking and slagging, and thus the cleaning of the surface.

An explosive mixture can be provided in the receiving space subsequently to the explosion, by way of renewed opening of the at least one metering fitting.

The at least one gaseous component according to a first variant can already correspond to the explosive, gaseous mixture, which is introduced into the cleaning apparatus.

According to a second variant, at least two and in particular two gaseous components are introduced separately into the cleaning apparatus and there are mixed with one another into the explosive, gaseous mixture.

In particular a mixing zone, in which the first and the second gaseous component are mixed into the explosive, gaseous mixture, is formed in the receiving space of the cleaning apparatus for this.

Accordingly, two or more pressure containers, metering fittings, feed conduits and, as the case may be, check elements, in particular of the type and arrangement described above and hereinafter are provided for this.

The first gaseous component in particular is a fuel. The fuel can be from the group of combustible hydrocarbons such as acetylene, ethylene, methane, ethane or propane.

The second gaseous component in particular is an oxidation agent (oxidant), such as e.g. gaseous oxygen or an oxygen-containing gas.

Gaseous components mean that the components concerned are present in gas form at the latest in the explosive, gaseous mixture, directly before the ignition.

The at least one gaseous component in particular is present as a gas already on introduction into the cleaning apparatus. On the other hand, the gaseous component can be present in the pressure container at overpressure in liquid form or partly in liquid form.

The at least one pressure container in particular is fed with the at least one gaseous component from a storage means. The filling of the at least one pressure container is controlled via a suitable filling fitting. The filling fitting can likewise be controlled, i.e. opened or closed, via the control device. The filling fitting in particular is connected to the control device via a suitable control lead. The filling fittings in particular are valves such as magnet valves. The storage means can be a conventional gas bottle.

Thus the control device can, e.g., be designed, to end of the filling of the at least one pressure container, i.e. to close the filling fitting, as soon as the predefined maximal pressure in the pressure container and which is stored in the control device is measured via the pressure sensor at the pressure container.

The control device can include an input module, via which, for example, nominal values (setpoints) such as maximal pressure, nominal residual pressure or the quantities of gaseous components, which are to be introduced into the cleaning apparatus per cleaning cycle, are acquired. The control and data leads in the present description can basically be wire-connected or wireless.

The cleaning device according to a further development of the invention includes a first pressure container as well as a metering fitting. The first gaseous component is introduced from the first pressure container via the first metering fitting into the cleaning apparatus. The first gaseous component is introduced from the first pressure container into the cleaning apparatus, in particular via a first feed conduit.

The cleaning device moreover includes a second pressure container as well as a second metering fitting. The second gaseous component is introduced from the second pressure container into the cleaning apparatus via the second metering fitting. The second gaseous component is introduced from the second pressure container into the cleaning apparatus in particular via the second feed conduit.

The two gaseous components in particular are introduced into the cleaning apparatus in a stoichiometric quantity ratio to one another. The gaseous components in the cleaning apparatus are mixed with one another in a mixing zone, into the explosive, gaseous mixture. The mixing zone in particular lies in the receiving space of the cleaning apparatus.

The pressure sensor in particular serves for measuring the pressure in the pressure container during the introduction of the relevant gaseous component out of the pressure container into the cleaning apparatus. If the cleaning device includes several pressure containers for several gaseous components, then the cleaning device in particular has several pressure sensors for measuring the respective pressures in the pressure containers of the gaseous components during the introduction of the gaseous components out of the pressure container into the cleaning apparatus.

The metering fitting or the metering fittings are controlled by way of a control device in dependence on the pressure measurement values measured in the pressure container or pressure containers by way of the pressure sensor or sensors.

The pressure container or the pressure containers, for example, can have a maximal pressure of several bar, such as 10 bar or more, and in particular of 20 bar or more. Thus, a maximal pressure of 20 to 40 bar can be envisaged. The maximal pressure corresponds to the starting pressure in the pressure container in the pressure container at the beginning of the introduction of the gaseous component into the cleaning apparatus.

Means, such as compressors, can be provided for compressing the gaseous components in the pressure container. This is particularly the case if the gaseous component in the storage means, from which the pressure container is fed with the gaseous component, has a lower starting pressure than the predefined maximal pressure.

The maximal pressure mentioned above permits the feed of the explosive mixture or its starting components at a high pressure and accordingly at a high speed, into the receiving space of the cleaning apparatus, in which atmospheric pressure prevails for example.

The nominal residual pressure e.g. has an overpressure of 0.5 bar or more, in particular of 1 bar or more, or even 2 bar or more, or 3 bar or more. Thus, the gas introduction speed, for example, at an overpressure of 1 to 2 bar can already be about 30% greater. The gas introduction duration is accordingly shortened.

The nominal residual pressure can also be 5 bar or more, or 10 bar or more. The greater the nominal residual pressure, the greater the average speeds that are possible, since the introduction speed is still comparatively high even at the end of the introduction, due to the high nominal residual pressure.

The cleaning apparatus in particular includes at least one outlet opening, via which the explosive mixture and/or the explosive pressure wave can exit out of the receiving space, e.g. a gas receiving channel, into the interior of the installation to be cleaned or into a container envelope, which is attached on the cleaning apparatus. The at least one outlet opening is open to the outside, in particular during the ignition and explosion of the explosive mixture. The at least one outlet opening is open to the outside in particular during the introduction of the at least one gaseous component into the cleaning apparatus.

The component of the ignition device, which is effective with regard to the ignition and is for the ignition of the explosive, gaseous mixture, in particular is arranged in the receiving space, such as the gas receiving channel, of the cleaning apparatus. In particular, the explosive, gaseous mixture, which is provided in the receiving space such as gas receiving channel, is brought to explosion by way of the ignition device. The explosive, gaseous mixture in particular is ignited by way of the control device via the ignition device.

The ignition is effected, e.g., by way of electrically triggered spark ignition, by way of auxiliary flame or by way of pyrotechnic ignition with the help of suitably attached ignition means and ignition devices. The ignition device in particular is an electric ignition device, and is designed for igniting an ignition spark or in particular an electric arc.

In each case, one or more metering fittings for the metered introduction of the gaseous components from the pressure container into the cleaning apparatus can be assigned to each pressure container. Several metering fittings are provided per pressure container, and thus in particular separate feed conduits are also assigned to these in each case.

The flow cross-sectional area of the metering fitting or of the metering fittings of the at least two gaseous components in particular are in a stoichiometric ratio to one another.

The number of metering fittings per pressure container in particular corresponds to the stoichiometric ratio of the gaseous components, which are introduced from the respective pressure containers and are for producing the explosive gaseous mixture.

One can also envisage several pressure containers, each being provided with one or more feed conduits and metering fittings per gaseous component. The number of pressure containers per gaseous component can correspond to the stoichiometric ratio of the fed gaseous components.

The size reduction of the storage space in the pressure container during the introduction of the at least one gaseous component into the cleaning apparatus, according to a further embodiment can be achieved amongst others according to the following described two variants.

According to a first variant, the pressure container can cooperate with an expulsion device, by way of which the gaseous component is expelled amid the size reduction of the storage space in the pressure container, during the introduction into the cleaning apparatus.

The expulsion device can include an expulsion element, such as a plunger or expulsion cylinder, for example. The expulsion element thereby is moved into the storage space. The expulsion element can include a guide cylinder that is led in a guide sleeve. The expulsion element can be hydraulically, pneumatically or motor driven. The drive in particular is active.

One can also envisage an expulsion gas such as nitrogen, being introduced into an expulsion storage means with a gas receiving space of a changeable size, for driving or propelling the expulsion element. An expulsion element is set into movement by way of the size or volume increase of the expulsion storage means, which is effected by way of the gas introduction, and this expulsion element for its part reduces the size of the storage space of the pressure container. The expulsion element, which e.g. can be an expulsion cylinder, can cooperate with an expandable balloon or a bellows structure. The compensation storage means can, e.g., be formed by way of an expandable balloon or bellows structure.

The expulsion element is moved back again amid enlargement of the storage space, with a renewed filling of the storage space with the gaseous component. Thus, for example, the expulsion gas can be led out of the expulsion storage means again.

According to a second variant, the storage space of the pressure container cooperates with a compensation storage means which, via a displacement element, is delimited from the storage space of the pressure container. The compensation storage means forms a gas receiving space of a changeable size. A compensation gas, e.g. nitrogen, is contained in the compensation storage means. The displacement element due to the increasing pressure in the storage space displaces amid the enlargement of the storage space and amid the size reduction of the compensation storage means, when the storage space is filled with the gaseous component. The compensation gas in the compensation storage means is accordingly compressed, by which means the pressure in the compensation storage means is increased.

On introduction of the gaseous component from the storage space into the cleaning apparatus, the displacement element displaces due to the reducing pressure in the storage space and the greater pressure in the compensation storage means, amid the size reduction of the storage space and enlargement of the compensation storage means.

The displacement element with these procedures in particular displaces away from the storage space and to it.

The energy of the compensation gas which is compressed in the compensation storage means is thus utilised, in order to at least partly expel the gaseous component in the storage space of the pressure container by way of the displacement element. The compensation gas in the compensation storage means is relaxed with this procedure, by which means the pressure in the compensation storage means reduces.

The displacement element can be a flexible membrane 33, 33' (see FIG. 3) between the storage space 34, 34' (see FIG. 3) and the compensation storage means 35, 35' (see FIG. 3). The membrane 33, 33' can be stretchable. The displacement element can also include a displaceable cylinder, in particular a cylinder, which is displaceable in a guide sleeve. The displacement means, in particular, can be a double cylinder. The displacement element can also interact with an expandable balloon or a bellows structure. The compensation storage means can, e.g., be formed by an expandable balloon or the bellows structure.

According to the embodiment according to the two mentioned variants, an end-switch can be provided, by way of which the ignition is triggered via the control device. The end-switch can be triggered, for example, by way of contact with the expulsion element or displacement element when this has reached a desired/nominal position during the expulsion procedure.

According to a particular further development of the invention, the cleaning apparatus is a longitudinal component with a feed-side and a cleaning-side end section. With regard to the feed-side end section it is the case of that end section, at which the at least one gaseous component is introduced into the cleaning apparatus. As the case may be, the term user-side end section can also be applied, since this end section as a rule is towards the user. The feed-side end section can form a grip part, via which the cleaning apparatus can be held by the user.

With regard to the cleaning-side end section, it is the case of that end section which is directed to the location to be cleaned.

The longitudinal component in particular includes a gas receiving channel, also called gas leading channel, which runs in the longitudinal extension. The gas receiving channel in particular is closed.

The gas receiving channel in particular is a feed channel for the feed of the explosive, gaseous mixture from the feed-side to the cleaning-side section. The gas-receiving channel in particular forms the receiving space or a part thereof. The has receiving channel ends in the cleaning-side end section and there in particular forms one or more outlet openings.

The closed gas receiving channel can be designed as a pipe, also termed gas receiving pipe or gas leading pipe. The pipe can be rigid or flexible. A flexible pipe can e.g. be designed as a hose, such as a corrugated tube.

The longitudinal component can be designed for the attachment of a container envelope on the cleaning-side end section.

The longitudinal component in particular is designed for bringing the explosive, gaseous mixture as closely as possible to the location to be cleaned, before this mixture is made to explode.

The at least one gaseous component in particular at the feed-side end section can be introduced out of the at least one pressure container into the longitudinal component, via the at least one metering fitting. The introduction in particular is effected via a feed conduit.

The at least one metering fitting for the metered introduction of the at least one gaseous component out of the at least one pressure container into the longitudinal component in particular is attached in the feed-side end section.

If several metering fittings are provided on the cleaning apparatus for a starting component in each case, then these can be arranged one after the other e.g. in the longitudinal extension of the cleaning apparatus, such as longitudinal component. Several metering fittings in each case for one starting component, considered transverse to the longitudinal extension, can also be arranged along the periphery of the receiving space, such as gas receiving pipe.

In particular, an inner pipe is arranged within the gas receiving pipe, in the feed-side end section. The two pipes can be arranged concentrically to one another.

The inner pipe in particular forms a first introduction channel for the introduction of a first, gaseous component out of the first pressure container. In particular a second, annular introduction channel is formed between the gas receiving pipe and the inner pipe, for introducing a second gaseous component. The inner pipe in particular ends in the gas receiving pipe.

The flow of the at least one gaseous component subsequently to its introduction in particular runs in the longitudinal extension of the longitudinal component in the direction of the cleaning-side end section.

The first introduction channel runs out in the direction of the cleaning-side end section at the mentioned end of the inner pipe, in an outlet opening. The first and second introduction channel, at the end of the inner pipe in particular merge into the gas receiving channel, in particular into a feed channel. A mixing zone in particular is formed at the end of the inner pipe, in which mixing zone the gaseous components, which flow out of the first and second introduction channel in the direction of the cleaning-side end section, are mixed into an explosive, gaseous mixture.

The cleaning apparatus or the longitudinal component in particular is a cleaning lance. The length of the longitudinal component or of the gas receiving channel can, e.g., be 1 m (meter) or more, or 2 m or more, or 3 m or more or 4 m or more. The cleaning apparatus or the longitudinal component, in particular under the hot constraints, can have a length of one to several meters, e.g. of 4 to 10 m. The cleaning apparatus can even have a length of up to 40 m if, e.g., the gas introduction duration has no significance, for cleaning in a cold environment.

The gas receiving channel can form a circular cross section. The (largest) diameter of the gas receiving channel can be 150 mm (millimeters) or less, or 100 mm or less, or 60 mm or less, and in particular 55 mm or less. The diameter can further be 20 mm or more, or 30 mm or more, in particular 40 mm or more.

The cleaning apparatus can also be designed for forming a cloud outside the cleaning apparatus. In this case, the explosive, gaseous mixture via the outlet opening does not flow into the container envelope, but directly into the interior of the installation to be cleaned.

The cleaning apparatus, towards the cleaning-side end section can include an outlet device with an additional receiving space for an explosive, gaseous mixture.

The present invention has the advantage that the gaseous component is introduced at a greater speed than with conventional methods, according to which the pressure container is simply emptied to ambient pressure without further measures.

The predefined quantity of gaseous component can be introduced into the cleaning apparatus within a comparatively short time thanks to the invention.

Thus the sojourn time of the container envelope in the hot interior of the installation can be reduced by the comparatively rapid filling of the container envelope. The danger of damage to the container envelope due to the heat and before the triggering of the explosion is considerably reduced on account of this.

On the other hand, container envelopes that are more sensitive to heat, e.g. of plastic, can be applied due to the shorter sojourn duration. These container envelopes are characterised, for example, by way of them being inexpensive in manufacture. On the other hand, such container envelopes are also characterised in that these are combusted without any residues. This is not always the case with conventional, more heat-resistant container envelopes, due to the applied paper material.

The quantity of gaseous component, which is introduced into the cleaning apparatus but also which was previously introduced into the pressure container can be controlled in an exact manner via pressure measurements at the pressure container.

The pressure difference method according to the invention moreover permits a monitoring of the gas introduction procedure with regard to possible malfunction. Thus, for example, a time limitation with regard to the introduction of gas into the cleaning apparatus can be provided in the control device. Thus, the metering fittings are closed on reaching a maximal opening time, independently of whether the nominal residual pressure has already been reached or not.

A pressure sensor, which is connected to the control device and which measures the pressure in the receiving space of the cleaning apparatus can be provided in a further development of the invention. The introduction procedure can be aborted and no ignition triggered in the case that the measured pressure exceeds a critical pressure value during the introduction of the at least one gaseous component, e.g. at a certain point in time or in a certain time interval of the introduction.

Specifically, it may occur, for example, that the gaseous component(s) cannot flow into the cleaning apparatus or only at a reduced speed due to an extraordinary flow resistance in the cleaning apparatus. The gas pressure in the receiving space of the cleaning apparatus as a further consequence lies above the normal gas pressure during the introduction procedure.

Thus, for example, according to a first possible scenario, the flow cross section can be significantly reduced with a kink, which is to say abrupt bend. in a flexible corrugated pipe of the cleaning apparatus. The container envelope does not unfold or not completely, according to a further scenario. In both cases, the gaseous component is prevented from flowing into the cleaning apparatus or into the associated container envelope by way of an extraordinary flow resistance.

The limitation of the opening time of the metering fittings then effects a premature stoppage of the introduction procedure without ignition of the already introduced gaseous components. The introduction procedure can be started afresh as soon as the fault has been overcome. One prevents the explosive mixture igniting despite the fluidic resistance in the cleaning apparatus on account of this, and thus the cleaning apparatus from becoming damaged.

BRIEF DESCRIPTION OF THE DRAWINGS

The subject-matter of the invention is hereinafter explained in more detail by way of preferred embodiment examples which are represented the accompanying drawings. In each case are shown schematically in.

DETAILED DESCRIPTION OF THE DRAWINGS

Figure 1:
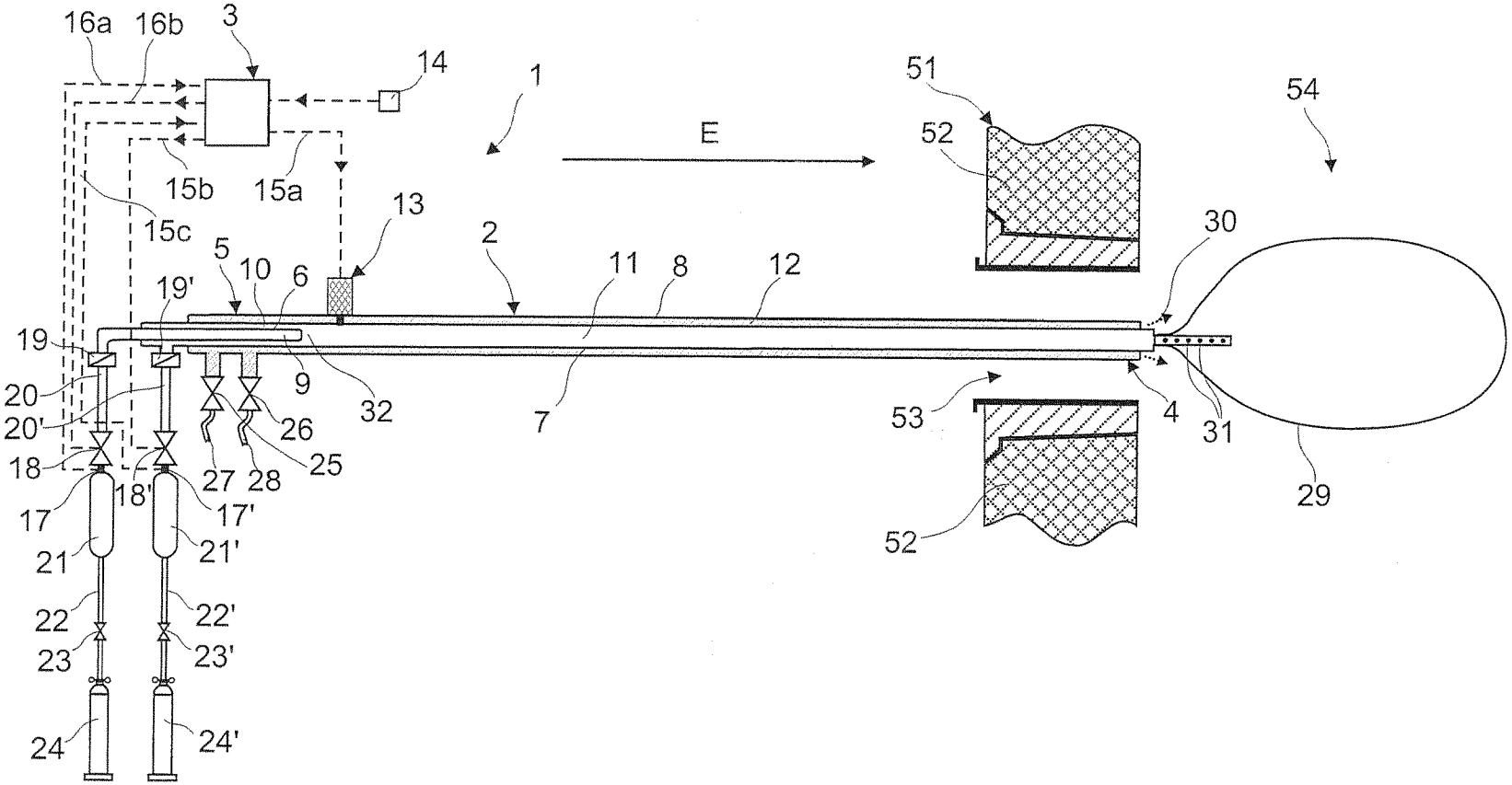
FIG. 1: an embodiment of a cleaning device according to the invention.

FIG. 1 schematically shows a cleaning device 1 for carrying out the cleaning method according to the invention. The cleaning device 1 includes a cleaning apparatus in the embodiment of a coolable cleaning lance 2. The cleaning lance 2 has an outer encasing pipe 8 and an inner gas receiving pipe 7, which is arranged within the outer encasing pipe 8 and which, amongst other things, forms the gas receiving channel or feed channel 11. The outer encasing pipe 8 encases the inner gas receiving pipe 7 and forms an annular cooling channel 12 by way of this. The lance cooling and, with this, the encasing pipe 8 and the cooling channel 12 however are not an essential feature of the invention.

The cleaning lance 2 has a cleaning-side end section 4 and a feed-side end section 5.

The feed channel 11 includes outlet openings 31 for the explosive mixture, at the cleaning-side end section 4. A container envelope 29 is moreover attached on the cleaning-side end section 4. The container envelope 29 is fillable with the explosive, gaseous mixture, which is provided in the cleaning lance 2, via the feed channel 11 and the outlet openings 31.

The cleaning lance 2 at the feed-side end section 5 has an inner pipe 6, which is arranged in the gas receiving pipe 7. The inner pipe 6 forms a first introduction channel 9. The inner pipe 6 in the direction of the cleaning-side end section 4 ends in the gas receiving pipe 6 and forms an outlet opening for the first introduction channel 9.

A second, annular introduction channel 10 is formed between the outer gas receiving pipe 7 and the inner pipe 6. The two introduction channels 9, 10 at the end of the inner pipe 6, in the direction of the cleaning-side end section 4 merge into the feed channel 11, which is formed by the outer gas receiving pipe 7. A mixing zone 32 is formed in this transition, where the gas flows of the first and the second gaseous components meet. The gaseous, explosive components are mixed in the mixing tone 32 into the explosive gas mixture, and are led as a mixture through the feed conduit 11 in the direction of the container envelope 29.

The cleaning lance 2 moreover includes an ignition device 13 with an ignition-effective component, which in the feed channel 11 is arranged after the end of the inner pipe 6 considered in the direction of the cleaning-side end. The ignition device 13 is connected to a control device 3 via a control lead 15*a*.

The cleaning device 2 moreover includes a first storage means 24 in the form of a gas bottle, for feeding a first gaseous component into the cleaning lance 2. The first gas bottle 24 is connected via a first gas conduit 22 to a first pressure container 21. The first pressure container 21 is fed from the first gas bottle 24 with the first gaseous component. A filling fitting 23, in particular in the form of a valve is arranged between the first pressure container 21 and the first gas bottle 24, and permits a controlled feed of the first gaseous component out of the first gas bottle 24 into the first pressure container 21. A first pressure sensor 17 is provided on the first pressure container 21, for measuring the pressure in the first pressure container 21.

A first feed conduit 20 leads from the first pressure container 21 to the first introduction channel 9 of the cleaning lance 2.

A first metering fitting 18, in particular in the form of a valve, is arranged between the first pressure container 21 and the first introduction channel 9, and permits a metered introduction of the first gaseous component out of the first pressure container 21 into the first introduction channel 9. The metering fitting 18 is attached on the outlet of the first pressure container 21. A first check element 19 for preventing a backflow of explosive gas mixture, which is caused by the explosion, into the feed conduit 20, is attached between the metering fitting 18 and the first introduction channel 9. However, it is not absolutely necessary to provide the check element 19.

The cleaning device 2 moreover includes a second storage means 24' in the form of a second gas bottle for feeding a second gaseous component into the cleaning lance 2. The second gas bottle 24' is connected via a second gas conduit 22' to a second pressure container 21'. The second pressure container 21' is fed with the second gaseous component from the second gas bottle 24'. A second filling fitting 23', in particular in the form of a valve, which permits a metered feed of the second gaseous component from the second gas bottle 24' into the second pressure container 21' is arranged between the second pressure container 21' and the second gas bottle 24'. A second pressure sensor 17' is provided on the second pressure container 21', for measuring the pressure in the second pressure container 21'.

A second feed conduit 20' leads from the second pressure container 21' to the second, annular introduction channel 10 of the cleaning lance 2. A second metering fitting 18', in particular in the form of a valve, and which permits a metered introduction of the second gaseous component out of the second pressure container 21' into the second introduction channel 10 is arranged between the second pressure container 21 and the second introduction channel 10. The metering fitting 18' is attached at the outlet of the second pressure container 21'. Moreover, a second check element 19' for preventing a backflow of explosive gas mixture, caused by the explosion, into feed conduit 20', is attached between the second metering fitting 18' and the second introduction channel 10. The check element 19' however does not necessarily have to be provided.

The first gaseous component is a combustible gas such as acetylene, ethylene, or ethane for example. The second gaseous component is oxygen or an oxygen-containing gas, which, due to stoichiometry, is fed in a larger quantity through the larger, second introduction channel 10.

The filling of the pressure containers 21, 21' is effected in each case by way of opening the filling fittings 23, 23', by which means the gaseous component flows out of the gas bottle 24, 24' into the pressure container 21, 21'. The gaseous component in the pressure container 21, 21' can have a maximum pressure between 20 and 40 bar. The pressure containers 21, 21' thereby serve for metering the starting components, as will be described hereinafter in more detail.

The introduction of the gaseous components out of the pressure container 21, 21' into the associated introduction channel 9, 10 is effected in each case by way of opening metering fittings 18, 18', by which means the gaseous component flows out of the pressure container 21, 21' into the associated introduction channel 9, 10.

The metering fittings 18, 18' are controlled, i.e. opened or closed, via control leads 15*b*, 15*c*, by way of the control device 3.

The control device includes an input module 14 for inputting control-relevant parameters, as has already been explained further above.

The gaseous starting components are introduced out of the pressure containers 21, 21' into the cleaning lance 2, in defined quantities and in the stoichiometric ratio. A defined quantity or volume of explosive, gaseous mixture in the correct stoichiometric ratio is produced in this manner. It is only the correct stoichiometric ratio of the gaseous starting components, which renders the gas mixture really explosive in the first place.

The exact quantities of the gaseous components can be computed on the basis of the desired quantity of explosive, gaseous mixture and of the known stoichiometric ratio of the gas components. Then, on the basis of a maximal pressure at the beginning of the gas introduction, a nominal residual pressure, at which the predefined quantity of gas has been discharged out of the pressure container when reached, can be ascertained due to the fact that the quantity of gaseous component, which is discharged from the pressure container, can be computed from the differential pressure in the pressure container.

Thus, a value for the nominal residual pressure is stored in the control device. The pressure sensors 17, 17' are connected to the control device 3 via suitable data leads 16*a*, 16*b*. The pressure prevailing in the pressure container 21, 21' is repeatedly measured during the discharge of the gas out of the pressure container 21, 21', via the control device 3 by way of the mentioned pressure sensors 17, 17' on the pressure container 21, 21'. The metering fittings 18, 18' are closed via the control device 3 as soon as the measured pressure corresponds to the nominal residual pressure, and thus the introduction of gas into the cleaning lance 2 is stopped. As was hitherto the case, the pressure container 21, 21' has a certain quantity of gaseous component, since the pressure container 21, 21' has a nominal residual pressure which lies above the ambient pressure.

In contrast, with conventional methods, the pressure container is filled with precisely the defined quantity of gas. Accordingly, the pressure container is emptied on introducing the gaseous component into the cleaning lance.

The explosive mixture is ignited via the control device 3 by way of the ignition device 13, after completing the introduction of the explosive mixture into the cleaning lance 2 and after filling the container envelope 29 with the explosive, gaseous mixture. The explosive mixture is ignited in the feed channel, wherein the explosion propagates into the container envelope 29 and causes this to explode.

A viscous coolant is introduced into the annular cooling channel 12, which is formed by the outer encasing pipe 8 and the inner-lying gas receiving pipe 7, and led in the direction of the cleaning-side end section 4. The coolant cools the gas receiving pipe 7 and thus the cleaning lance 2.

The cleaning lance 2 at its feed-side end section 5 or in its vicinity accordingly comprises connections for the feed conduits 27, 28 of the coolant feed in each case. Water, for example, is fed through the first feed conduit 27, and air for example through the second feed conduit 28. One can also provide only one coolant feed conduit for the feed of only one coolant, e.g. water.

The coolant, e.g. a water/air mixture is led through the coolant channel 12. The coolant at the cleaning-side end section 4 exits out of the coolant channel 12 via an outlet opening, which is indicated by arrows 30. The exiting coolant additionally cools the container envelope 29. A closed coolant circuit can, however, also be provided.

The introduction of the coolant components into the coolant channel 12 is controlled via suitable fittings 25, 26 such as valves. The actuation of these permits a connection and disconnection of the cooling. This active lance cooling or the valves 25, 26 can be actuated by hand or controlled via the control device 3. The fittings 25, 26 are accordingly connected to the control device 3 via control leads (not shown).

The coolant channel 12 can also be designed merely for passive cooling and act in an insulating manner and in this manner protect the cleaning lance 2 and the explosive gas mixture or its components, which are located therein, from being heated.

The lance cooling described above, is optional as has already been explained, and is not an essential feature of the ignition.

The cleaning-side end section 4 of the cleaning lance 2 with the container envelope 29, which is attached thereon, is introduced through the passage opening 53 in the wall 52 of a combustion installation 51 in the introduction direction E, into its interior 54, for carrying out the cleaning method according to the invention. A predefined quantity of gas, as described above, is led out of the pressure containers 21, 21' into the cleaning lances 2, by way of actuating the metering valves 18, 18'. The gas is thereby introduced in a relative short time. The introduction can last below one second to a few seconds, depending on the magnitude of the selected maximal pressure and the quantity to be introduced. The introduction speed of the gaseous components cannot be set infinitely high with the use of a container envelope 29. Accordingly, limits are set with regard to the introduction time of the gas components.

The explosive mixture is ignited by way of the ignition device 13 directly after the closure of the metering valves 18, 18' or with a temporal delay and brought to explode.

Figure 2:
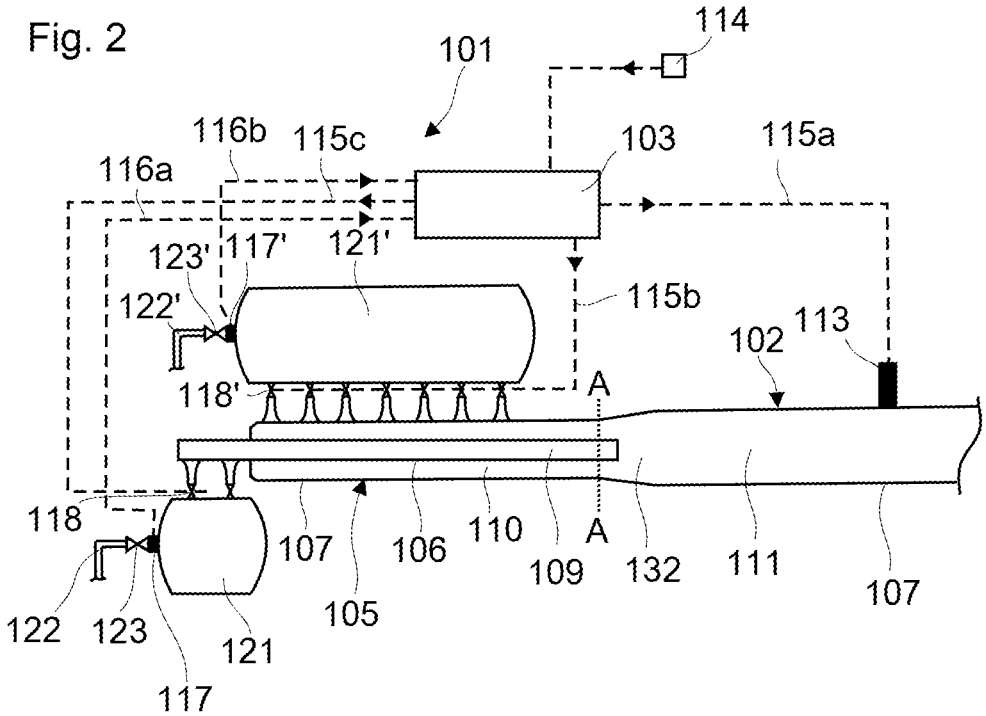
FIG. 2: a further embodiment of a cleaning device according to the invention.
Figure 3:
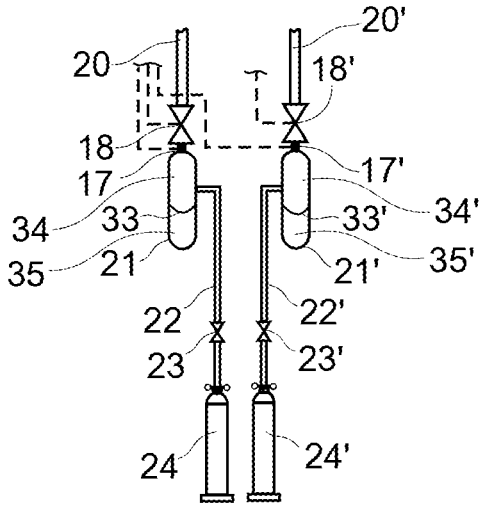
FIG. 3: a detailed portion of an embodiment of a cleaning device according to the invention.

The embodiment of a cleaning device 101 according to FIG. 2 shows a cleaning lance 102 with comparable construction as the cleaning device 1 according to the embodiment example according to FIG. 1.

The cleaning lance 102 likewise includes a gas receiving pipe 107, which forms a feed channel 111. An inner pipe 106, which forms a first introduction channel 109 and ends in the gas receiving pipe 107 amid the formation of an outlet opening, is arranged in the gas receiving pipe 107 at the feed-side end section 105.

A second, annular introduction channel 110 is likewise formed between the inner pipe 106 and the gas receiving pipe 107. The first and the second introduction channel 109, 110 at the end of the inner pipe, in the direction of the cleaning-side end section (not shown) merge into the feed channel 111, amid the formation of a mixing zone 132.

The cleaning device 101 likewise has a control device 103 with an input module 114. The cleaning device 101 moreover includes a first and a second pressure container 121, 121' for the feed of a first and second gaseous component. The feed of the gaseous starting components to the pressure containers 121, 121' is effected via suitable gas conduits 122, 122' and filling fittings 123, 123'.

Pressure sensors 117, 117', which are connected to the control device 103 via data leads 116*a*, 116*b*, are also provided on the pressure containers 121, 121'.

An ignition device 113, which is connected via the control lead 115*a* to the control device 103, is likewise provided on the cleaning lance 102.

The present cleaning device 101 then differs from the cleaning device 1 according to FIG. 1 by way of a plurality of first metering fittings 118, in particular valves, which are connected in parallel and through which the first combustible component is introduced from the first pressure container 121 into the first introduction channel 109. The cleaning device 101 moreover has a plurality of second metering fittings 118', in particular valves, which are connected in parallel and through which the second gaseous component (oxygen) is led from the second pressure container 121' into the second introduction channel 110. The number of the first and second metering fittings 118, 118' thereby is in a stoichiometric relation with the fed gaseous components. In the present example, the ratio is 2:7, which corresponds to the stoichiometric ratio of combustible gas to oxygen.

The metering fittings 118, 118' are connected to the control device 103 via suitable control leads 115*b*, 115*c*.

The invention claimed is:

1. A method for removing deposits in interiors of receptacles and installations, with a cleaning device by way of explosion technology, wherein the cleaning device comprises a cleaning apparatus with a receiving space, and at least one pressure container that is connected to the cleaning apparatus via at least one metering fitting, comprising the steps of:

providing at least one gaseous component in the pressure container at overpressure;

introducing the at least one gaseous component from the pressure container into the cleaning apparatus via the metering fitting;

providing an explosive, gaseous mixture in the receiving space, comprising or consisting of the at least one introduced gaseous component;

igniting the explosive, gaseous mixture;

wherein, for optimizing the introduction of the at least one gaseous component out of the pressure container into the cleaning apparatus:

the control of the introduction of the at least one gaseous component into the cleaning apparatus is effected based upon a differential pressure between a maximal pressure at the beginning of the introduction and a nominal residual pressure after completion of the introduction, wherein the nominal residual pressure is at the overpressure, or the storage space in the at least one pressure container is reduced in size during introduction of the at least one gaseous component into the cleaning apparatus.

2. The method according to claim 1, wherein, based on the maximal pressure, the nominal residual pressure is ascertained on the basis of the quantity of gaseous component which is to be introduced, and the introduction of the at least one gaseous component is stopped on reaching the nominal residual pressure.

3. The method according to claim 1, wherein the cleaning apparatus is designed for the attachment of a container envelope that can be filled with the explosive, gaseous mixture, with the following steps:

attaching a container envelope on the cleaning apparatus;

providing the at least one gaseous component in the pressure container at overpressure;

introducing the at least one gaseous component from the pressure container into the cleaning apparatus via the metering fitting;

providing an explosive, gaseous mixture in the receiving space, comprising or consisting of the at least one introduced, gaseous component, and filling the container envelope attached on the cleaning apparatus, with an explosive, gaseous mixture;

igniting the explosive gaseous mixture, wherein the explosive, gaseous mixture in the container envelope is made to explode.

4. The method according to claim 1, wherein the cleaning device comprises a first pressure container for introducing a first gaseous component and a second pressure container for introducing a second gaseous component, and the gaseous components are introduced in a stoichiometric quantity ratio to one another and are mixed in the cleaning apparatus into the explosive, gaseous mixture.

5. The method according to claim 1, wherein the pressure in the pressure container is measured by way of at least one pressure sensor, during the introduction of the at least one gaseous component.

6. The method according to claim 5, wherein the at least one metering fitting is controlled by way of a control device in dependence on the pressure measurement values which are detected in the pressure container by way of the at least one pressure sensor.

7. The method according to claim 1, wherein the nominal residual pressure corresponds to an overpressure of 2 bar or more.

8. The method according to claim 6, wherein the explosive, gaseous mixture is ignited via an ignition device by way of the control device.

9. The method according to claim 4, wherein a mixing zone is formed in the cleaning apparatus, in which mixing zone the first and the second gaseous components are mixed into the explosive, gaseous mixture.

10. A cleaning device for removing deposits in interiors of receptacles or installations by way of explosion technology for carrying out the method according to the claim 1, comprising:

a cleaning apparatus with a receiving space for providing an explosive, gaseous mixture from one or with at least one gaseous component;

at least one pressure container that is connected to the cleaning apparatus and is for providing and introducing the at least one gaseous component into the cleaning apparatus;

at least one metering fitting for the metered introduction of the at least one gaseous component out of the at least one pressure container, into the cleaning apparatus;

an ignition device for igniting the explosive, gaseous mixture;

a control device for the control of the at least one metering fitting and for the ignition of the explosive mixture, wherein the cleaning device comprises a system for optimizing the introduction of the at least one gaseous component out of the pressure container into the cleaning apparatus, wherein the system comprises:

the control device, which is designed for the control of the at least one metering fitting in dependence on pressure measurement values detected via at least one pressure sensor in the pressure container, in a manner such that the control device is in the position of ending the introduction of the at least one gaseous component out of the at least one pressure container into the cleaning apparatus, as soon as the measured pressure in the pressure container corresponds to a nominal residual pressure, which is at the overpressure, or a device for size reduction of the storage space in the pressure container during the introduction of the at least one gaseous component into the cleaning apparatus.

11. The cleaning device according to claim 10, wherein the cleaning apparatus is designed for attaching a container envelope, which is fillable with an explosive, gaseous mixture.

12. The cleaning device according to claim 10, wherein the cleaning device comprises a first pressure container and a first metering fitting for introducing a first gaseous component, and a second pressure container and a second metering fitting for introducing a second gaseous component, into the cleaning apparatus.

13. The cleaning device according to claim 10, wherein the receiving space comprises a gas feed channel for feeding the explosive mixture into a container envelope, which is attached on the cleaning apparatus.

14. The cleaning device according to claim 10, wherein an ignition-effective component of the ignition device for igniting the explosive gaseous mixture is arranged on the cleaning apparatus.

15. The cleaning device according to claim 12, wherein in each case one or more metering fittings for introducing the gaseous components into the cleaning apparatus are assigned to each pressure container, wherein the number of metering fittings per pressure container corresponds to the stoichiometric ratio of the gaseous components, for the production of the explosive, gaseous mixture.

16. The cleaning device according to claim 10, wherein the cleaning apparatus is a longitudinal component with a longitudinal extension and having a feed-side end section and a cleaning-side end section, and the longitudinal component comprises a gas feed channel, which runs in the longitudinal extension and is for the feed of the explosive, gaseous mixture from the feed-side end section to the cleaning-side end section.

17. The cleaning device according to claim 16, wherein the container envelope can be attached on the cleaning-side end section.

18. The cleaning device according to claim 16, wherein the at least one metering fitting for the metered introduction of the at least one gaseous component out of the at least one pressure container into the longitudinal component is attached in the feed-side end section.

19. The cleaning device according to claim 10, wherein the cleaning apparatus is a cleaning lance.

20. The cleaning device according to claim 12, wherein the cleaning apparatus comprises a gas receiving pipe, and an inner pipe is arranged within the gas receiving pipe, in the feed-side end section, and the inner pipe forms a first introduction channel for introducing a first, gaseous component out of the first pressure container, and a second, annular introduction channel for the introduction of a second gaseous component is formed between the gas receiving pipe and the inner pipe, and the inner pipe ends in the gas receiving pipe, wherein a mixing zone is formed at the end of the inner pipe, and the first and second introduction channel merge into a gas receiving channel, in particular into a feed channel.

* * * * *